United States Patent [19]

Niikura

[11] 4,027,610

[45] June 7, 1977

[54] INTERMITTENT STITCHING DEVICE FOR SEWING MACHINES

[75] Inventor: Masakatsu Niikura, Kokubunji, Japan

[73] Assignee: Janome Sewing Machine Co. Ltd., Tokyo, Japan

[22] Filed: June 23, 1975

[21] Appl. No.: 589,533

[30] Foreign Application Priority Data

June 26, 1974 Japan ..... 49-72233

[52] U.S. Cl. ..... 112/275

[51] Int. Cl.[2] ..... D05B 69/10

[58] Field of Search ..... 112/219 R, 219 A, 219 B, 112/220, 221, 67, 87

[56] References Cited

UNITED STATES PATENTS

| | | | |
|---|---|---|---|
| 2,847,956 | 8/1958 | Hale | 112/219 A |
| 3,253,685 | 5/1966 | Marola et al. | 112/219 A |

*Primary Examiner*—H. Hampton Hunter

*Attorney, Agent, or Firm*—Michael J. Striker

[57] ABSTRACT

The invention relates to an intermittent stitching device for sewing machines which is composed of a mechanical stopping device for stopping the upper drive shaft of the sewing machine at a determined position and an electric circuit for controlling the operation of the stopping device so as to enable the sewing machine to produce desired intermittent stitches, in addition to the making of continuous stitches.

13 Claims, 10 Drawing Figures

INTERMITTENT STITCHING DEVICE FOR SEWING MACHINES

BACKGROUND OF THE INVENTION

In view of ever increasing demand for zigzag sewing machines, it is desirable that such machines be intermittently driven, for example, to baste and accordingly to make intermittent stitches, in addition to the conventional function of producing ordinary continuous stitches.

It would be truly convenient if the basting operation could be carried out with a sewing machine instead of by hand. However, it is presently necessary for the operator to manually handle a conventional sewing machine to make intermittent stitches with one hand operating the stopping device and with the other hand holding and guiding the material to be sewn. It is, therefore very difficult to sew curved parts, and other parts of the material where precise and correct stitching is required. Moreover, in presently known sewing machines of this kind, the mechanism is rather complex and expensive, and the needle stopping position cannot be determined with a requisite degree of accuracy. Accordingly, such a mechanism will not be appropriate for use in household sewing machines.

SUMMARY OF THE INVENTION

The present invention has been devised to eliminate the disadvantages of conventional sewing machines of this kind and to provide a sewing machine which can produce intermittent stitches without any adverse influence on the conventional functions of the sewing machine.

The primary object of this invention is to provide an intermittent stitching device in a conventional sewing machine which can be selectively employed to make desired intermittent stitches.

Another object of the invention is to provide a stopping device for stopping the upper drive shaft of the sewing machine at a predetermined position and an electric control circuit for controlling the operation of the stopping device, thereby to stop the upper drive shaft at the determined position after each complete rotation thereof by operating a control device in one way.

Another object of this invention is to provide a detaining device for the intermittent stitching device of this invention, thereby to automatically and successively rotate and stop the upper drive shaft by operating the control device in another way.

Still another object of this invention is to provide a simple and compact device for controlling and operating the intermittent rotation of the upper drive shaft of the sewing machine.

The other features and advantages of this invention will be apparent from the following description of the preferred embodiments in reference to the attached drawing.

DESCRIPTION OF THE PREFERRED EMBODIMENTS

Figure 1:
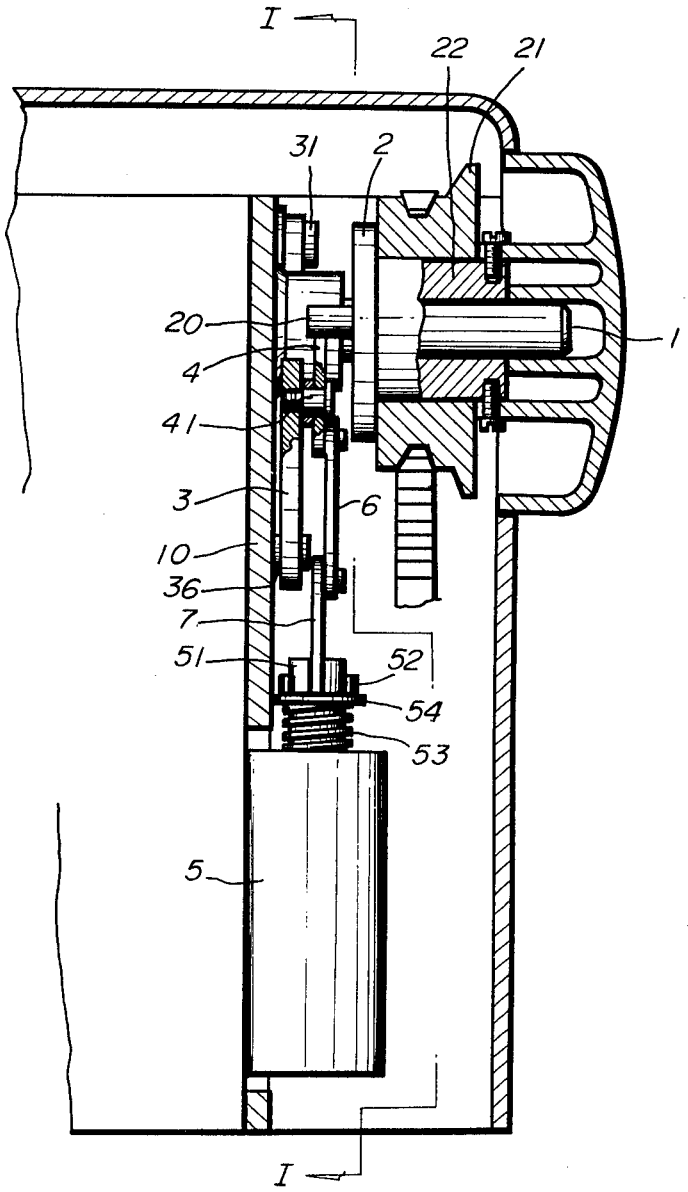
FIG. 1 is a side elevational view of a machine which embodies the present invention, showing one end portion of a sewing machine head partly in section.

Referring to FIGS. 1 to 4 illustrating a first embodiment of the invention, reference numeral 1 denotes an upper drive shaft of the sewing machine. Numeral 2 denotes an engaging member. Numeral 3 denotes a swingable lever, herein referred to as arresting means. Numeral 4 denotes a pawl which cooperates with the engaging member 2. Numeral 5 denotes a solenoid and numeral 8 an electric switch for stopping the upper drive shaft 1.

Figure 2:
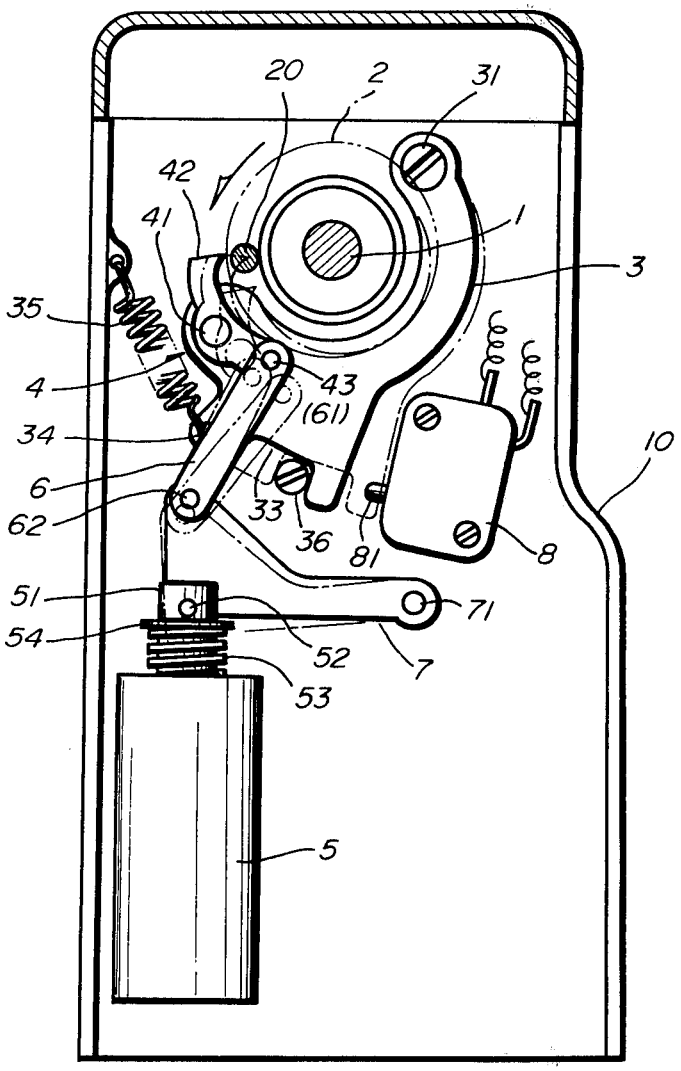
FIG. 2 is a sectional view taken along the line I — I of FIG. 1.
Figure 3:
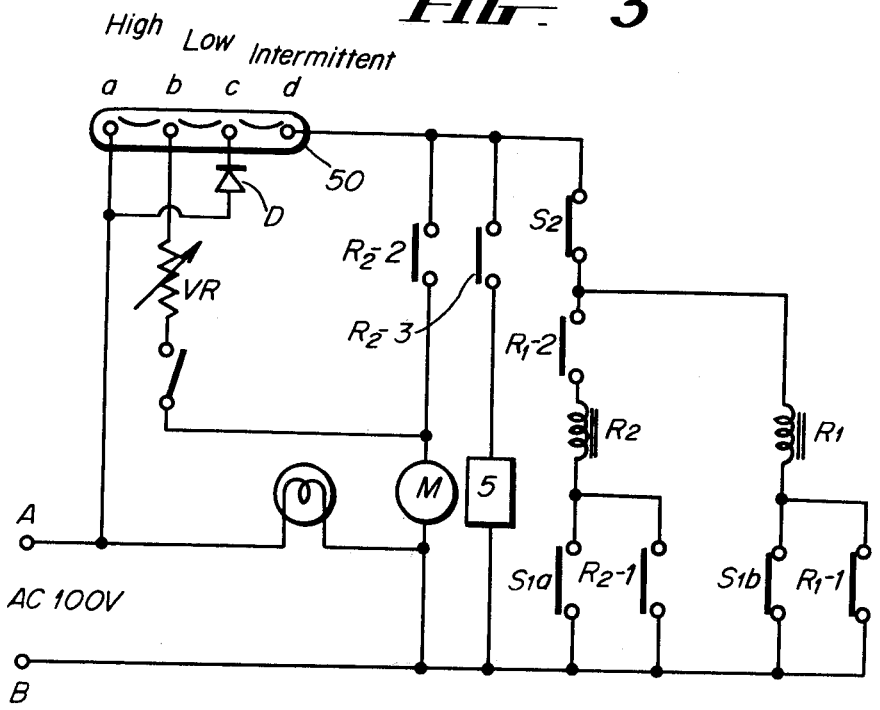
FIG. 3 illustrates the electric control circuit.
Figure 4:
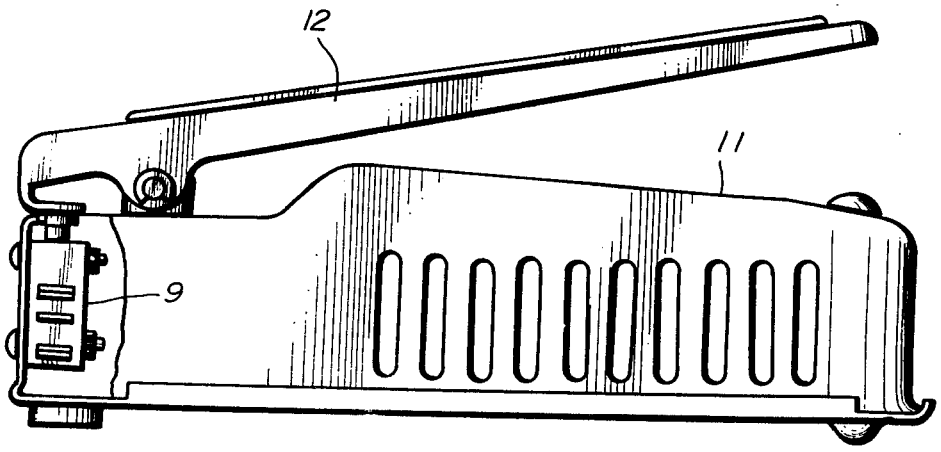
FIG. 4 is an elevational view of a foot controller, partly broken away to show a microswitch, for regulating the control circuit.

The upper drive shaft 1 is rotatably journalled in the machine head housing to drive the needle bar, the feed dog and other parts of the sewing machine. The engaging member 2 one embodiment of engaging means is composed of a bushing 22 fixed to the upper drive shaft and having a diametrically enlarged flange at the inner adjacent and end thereof and a pin 20 fixedly attached on the side face of the flange and parallel to the upper drive shaft. Pin 20 is a preferred embodiment of blocking means. A pulley 21 is provided on the bushing 22 to rotate the upper drive shaft 1 together with the engaging member 2. Thus, when the upper drive shaft 1 rotates, the pin 20 orbits along a predetermined path around the axis of the upper drive shaft. The location of the pin 20 is such that when the pin is engaged by the pawl during its orbital movement the upper drive shaft 1 is stopped with the thread take up lever (not shown) being stopped at its upper dead point, namely with the needle, whose movements are synchronized with those of the thread take up lever, arrested at its upper dead point. One end of the swingable lever 3 is turnably mounted on a pivot pin 31 on the support plate 10 located opposite to the engaging member 2 in the machine head and forming part of machine head housing. The other end of the swingable lever 3 has a forked portion 33, and the lever is biassed in a clockwise direction as viewed in FIG. 2, by means of a tension spring 35 provided between the support plate 10 and the other end of the swingable lever. An intermediate portion of the pawl 4 is turnably mounted on the other end of the swingable lever 3 by means of a pivot pin 41. The upper end of the pawl 4 is formed with pallet 42 and the lower end of the pawl is connected to a plunger or armature 51 of the solenoid 5 by means of a link 6 and an intermediate lever 7. One end of the link 6 is connected to the lower end of the pawl 4 by means of a pivot 43 and the other end of the link is connected to the upper part of the intermediate lever 7 by means of a pivot 62. The lower part of the intermediate lever 7 is connected to the plunger 51 of the solenoid 5 by means of a pivot 52, and the intermediate lever 7 is turnably mounted on the support plate 10 by means of a pivot 71. A coil spring 53 and washer 54 are positioned between the pivot 52 on the plunger 51 and the solenoid 5 so that the plunger 51 is always biassed upwardly when the solenoid is not energized. Both ends of the pivot 52 project beyond the plunger 51 to engage the upper side of the washer 54. A stop pin 36 is provided on the support plate 10 between the two prongs of the forked portion 33 of the swingable lever 3 so that the extent of clockwise pivoting of the swingable lever under the action of the tension spring 35 is limited by the pin 36 as shown in FIG. 2 by solid lines. The extent of counterclockwise pivoting of the swingable lever 3 against the action of the tension spring 35 is also limited by the pin 36 as shown in FIG. 2 by phantom lines. When the swingable lever 3 is pivoted in a counterclockwise direction until the movement is stopped by the pin 36, the right-hand prongs of the forked portion 33 of the swingable lever 3 depresses a button 81 of the electric switch 8 to deenergize the solenoid 5 and to stop an electric motor M (FIG. 3). The solenoid 5 and motor M are simultaneously connected with an energy source by closing a starting switch, diagrammatically shown in FIG. 3, which is confined in the foot controller 11 (FIG. 4). When the solenoid 5 is energized, the plunger 51 is pulled down. Accordingly, the intermediate lever 7 turns about the pivot 71, and the pawl 4 is turned in a clockwise direction around the pivot 41, all from the positions shown by solid lines to the positions shown by phantom lines in FIG. 2. The pallet 42 of the pawl 4 is brought into the path of movement of orbiting pin 20 of the engaging member 2. The pawl 4 is then engaged by the pin 20 of the engaging member 2 which rotates at a reduced speed in the direction indicated by the arrow, and the swingable lever 3 is turned in a counterclockwise direction against the action of the tension spring 35 from the position illustrated by solid lines to the position illustrated by phantom lines. In this turned position, the forked portion 33 of the swingable lever depresses the button 81 of the electric switch 8 to deenergize the solenoid 5 and to stop the motor M. Therefore, the pressure previously applied to the swingable lever 3 by the upper drive shaft 1 through the medium of the pin 20 of the engaging member 2 is terminated, and the swingable lever 3 is returned to the position illustrated by solid lines under the action of the tension spring 35. At the same time, the plunger 51 is returned to the raised position by the coil spring 53, and the pawl 4 is returned to the ineffective position illustrated by solid lines. The upper drive shaft 1 and the pin 20 remain in a position illustrated in FIG. 2 by solid lines. Therefore, if the position of the pin 20 is so selected with respect to the axis of the upper drive shaft 1 as to stop the needle at the upper dead point thereof where it is above the material to be sewn, the upper drive shaft of the sewing machine can be intermittently driven by repeatedly closing the starting switch in the foot controller 11 shown in FIG. 4, and intermittent stitches can be produced.

In order to operate the sewing machine in the manner as mentioned above, an electrical control circuit is required to control the operation of the sewing machine. The control circuit is mainly composed of a series circuit for connecting a starting switch, a stopping switch, a relay or intermediate switch and a changeover switch to a power source, a motor circuit and a solenoid circuit which are respectively connected in parallel to at least a part of the series circuit and alternately opened and closed depending upon the condition of the series circuit.

In FIG. 3, $S_1a$ and $S_1b$ are two contacts of a starting microswitch 9 arranged in the foot controller 11 as shown in FIG. 4, which can be alternately opened and closed in opposite phase. $S_2$ is a contact of the stopping microswitch 8 of 2 for controlling the operation to make intermittent stitches. With this explanation of the parts, the control circuit consists of a circuit for controlling the intermittent rotation of the upper drive shaft 1 of the sewing machine, a circuit for controlling the high speed rotation of the upper drive shaft, and a circuit for controlling the low speed rotation of the upper drive shaft. These circuits are under control of a switch 50. If the contacts (a) and (b) are connected to each other, the circuit from a power source terminal A, through a variable resistor VR, a switch, and motor M to the second power source terminal B is closed, to effect the high speed rotation of the upper drive shaft of the sewing machine. If the contacts (*b*) and (*c*) are connected to each other, the circuit from the power source A through a diode D, the variable resistor VR and the motor M to the power source terminal B is closed to effect the low speed rotation of the upper drive shaft. If the contacts (*c*) and (*d*) are connected to each other, the aforementioned two circuits are opened, and the circuit for controlling the intermittent rotation of the upper drive shaft is closed.

The circuit for controlling the intermittent rotation of the upper drive shaft 1 consists of a series circuit including the power source terminal A, the diode D, the contacts (*c*) and (*d*) of the switch 50, the contact $S_2$ of the stopping microswitch 8, the relay $R_1$, the contact $S_1b$ of the starting switch 9 and the power source terminal B; a series circuit including contact $R_1$-2 of the relay $R_1$, relay $R_2$ and contact $S_1a$ of the starting switch 9 which are all connected in parallel to the relay $R_1$ and the contact $S_1b$ of the starting switch 9; a relay contact $R_2$-1 connected in parallel to the switch contact $S_1a$; a relay contact $R_1$-1 connected in parallel to the switch contact $S_1b$; a series circuit including a relay contact $R_2$-3 and the solenoid 5 connected in series between the contact (*d*) of the switch 50 and the power source terminal B; and a series circuit including a relay contact $R_2$-2 and the motor M connected in series between the contact (*d*) of the switch 50 and the power source terminal B.

When the pedal 12 of foot controller 11 is not pressed down, the contact $S_1b$ of the starting switch 9 is closed and the contact $S_1a$ is open. Therefore, when the contacts (*c*) and (*d*) of the changeover switch 50 are connected to each other, the circuit of the power source terminal A, the diode D, the contact $S_2$, the relay $R_1$, the contact $S_1b$ and the power source terminal B is closed, and accordingly the relay $R_1$ is energized to close the contact $R_1$-1. Thus a holding circuit for relay $R_1$ is completed and simultaneously the contact $R_1$-2 is closed. Then, when the pedal 12 of the foot controller 11 is pressed down, the contact $S_1b$ of the starting switch 9 is opened and the contact $S_1a$ is closed to actuate the relay $R_2$, and the contact $R_2$-1 is closed. Thus, a holding circuit for the relay $R_2$ is completed, and simultaneously the contacts $R_2$-2 and $R_2$-3 are closed, and electric current is supplied to the machine motor M and the solenoid 5. Consequently, the upper drive shaft 1 of the sewing machine is rotated and the pin 20 of the engaging member 2 orbits while the pallet 42 of the pawl 4 is moved into the path of the pin 20 due to the action of the solenoid 5. The upper drive shaft 1 is rotated to a position where the pin 20 engages the pallet 42 of the pawl 4 while the needle is brought to its upper dead point where it is above the material to be sewn after it has sewn one stitch. Simultaneously, due to the impact transmitted to the pawl 4 by the pin 20, the lever 3 is turned against the action of the tension spring 35 and depresses the button 81 of the stopping switch 8. The contact $S_2$ of the stopping switch 8, therefore, is opened to deenergize the relays $R_1$ and $R_2$ and accordingly all the contacts of these relays are opened. Thus the motor M is arrested the solenoid 5 is deenergized, and the upper drive shaft 1 is stopped at a position where the swingable lever 3 is moved back under the action of the tension spring 35 to the extent determined by the stop screw 36, and the pawl 4 is withdrawn spaced from the path of movement of the pin 20 by the coil spring 53 as shown in FIG. 2, and the contact $S_2$ of the stopping switch 8 is closed again.

Accordingly in by repeatedly stepping on the pedal 12 of the controller 11 after it is released, the upper drive shaft 1 of the sewing machine is intermittently rotated and is operated to sew stiches one by one intermittently, and the needle is stopped at its upper dead point where it is above the material to be sewn when the upper drive shaft is stopped. The operator of the sewing machine, therefore, can manipulate the material to be sewn during the intervals between the making of intermittent stitches and therefore the operator can sew any part of the material.

Figure 5:
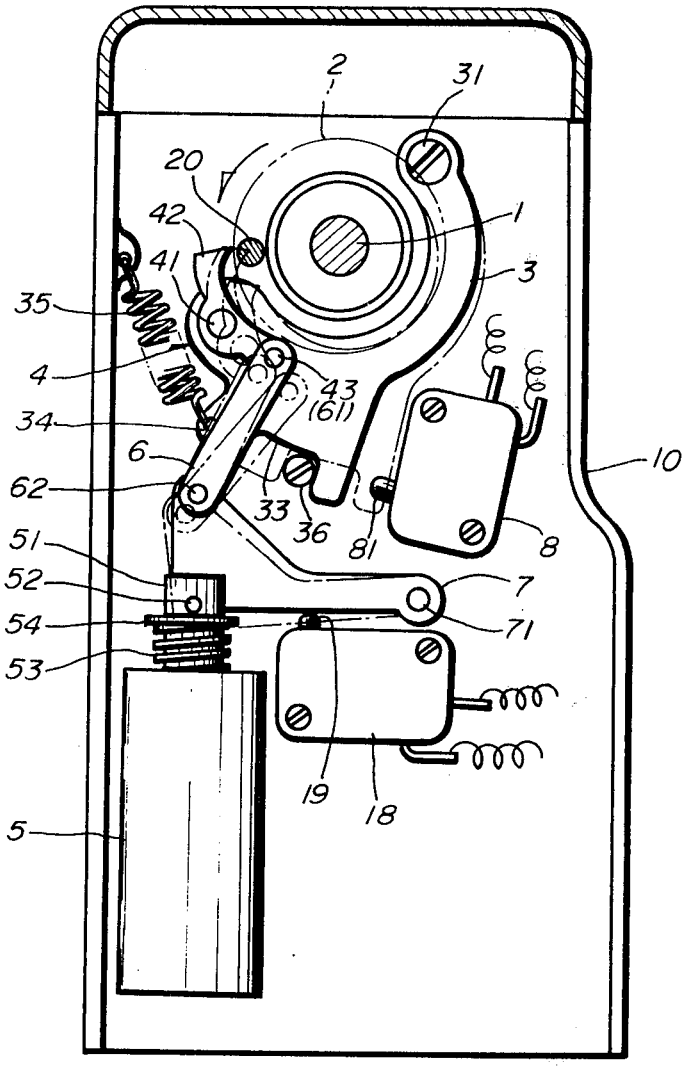
FIG. 5 is a sectional view of a second embodiment of the present invention.
Figure 6:
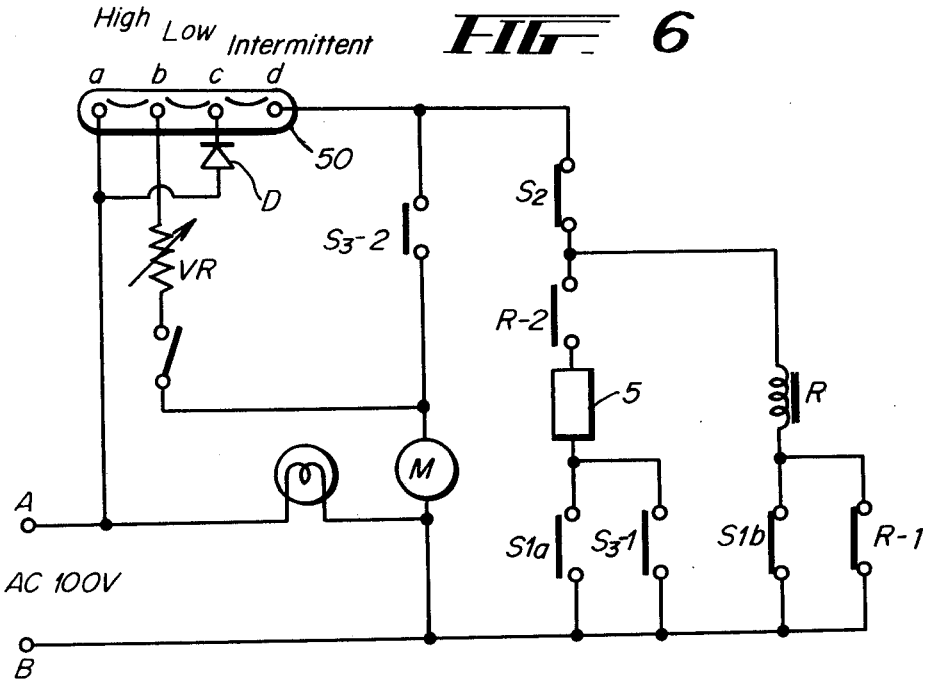
FIG. 6 illustrates an electric control circuit for use in the second embodiment of the invention.

FIG. 5 shows a second embodiment of this invention which differs from the first embodiment in that a power supply maintaining switch 18 is opened and closed by the intermediate lever 7, and that, in the control circuit (shown in FIG. 6) employs a single relay R. In this embodiment, the circuit for controlling intermittent rotation of the upper drive shaft 1 of the sewing machine consists substantially of a series circuit of the power supply terminal A, the diode D, the contacts (*c*) and (*d*) of the changeover switch 50, the contact $S_2$ of the stopping switch 8, the relay R, the contact $S_1b$ of the starting switch 9 and the power supply terminal B; a series circuit of the contact R-2 of the relay R, the solenoid 5 and the contact $S_1a$ of the starting switch 9 connected in parallel to the series circuit of the relay R and the contact $S_1b$; the contact $R_1$ of the relay R connected in parallel to the contact $S_1b$ of the starting switch 9; contact $S_{3\text{-}1}$ of the power supply maintaining switch 18 connected in parallel to the contact $S_1a$ of the starting switch 9; and a series circuit of contact $S_{3\text{-}2}$ of the switch 18 and motor M connected between the contact (*d*) of the changeover switch 50 and the power supply terminal B.

The contacts $S_2$ and $S_1b$ are, as in the first embodiment, closed when the pedal 12 of the controller 11 is not pressed down. When the contacts (*c*) and (*d*) of the changeover switch 50 are connected to establish the circuit for controlling the intermittent rotation of the upper drive shaft, the relay R is energized to close the contacts R, and $R_2$ whereby the contact R-1 completes a holding circuit for the relay R. When the pedal 12 of the controller 11 is pressed down, the contact $S_1a$ is closed, and the solenoid 5 is energized and pulls down the plunger 51, thereby to shift the intermediate lever 7, downwardly to move the pawl 4 into the path of movement of the pin 20. Simultaneously the intermediate lever 7 depresses the button 19 of the power supply maintaining switch 18, which closes the contacts $S_{3\text{-}1}$ and $S_{3\text{-}2}$ so that the motor M is started, and rotates the upper drive shaft 1. With the rotation of the upper drive shaft 1, the pin 20 of the engaging member 2 engages and pushes the pawl 4, and the swingable lever 3 is turned to depress the button 81 of the stopping switch 8 as in the first embodiment. The contact $S_2$ is opened so that the motor M is arrested, the solenoid 5 is deenergized and the rotation of the upper drive shaft 1 is terminated. Simultaneously the swingable lever 3 is returned to the position spaced from the button 81 of the stopping switch 8 by the action of the tension spring 35, and the pawl 4 is moved out of the path of movement of the pin 20 by the action of the coil spring 53. Simultaneously the lever 7 releases the button 19 of the power supply maintaining switch 18 so that the contacts $S_{3\text{-}1}$ and $S_{3\text{-}2}$ of the switch 18 are opened. Thus the operating cycle of the associated parts for controlling one rotation of the upper drive shaft 1 is completed and the stitching operation is interrupted until the operator again depresses the pedal 12 of the controller 11.

Figure 7:
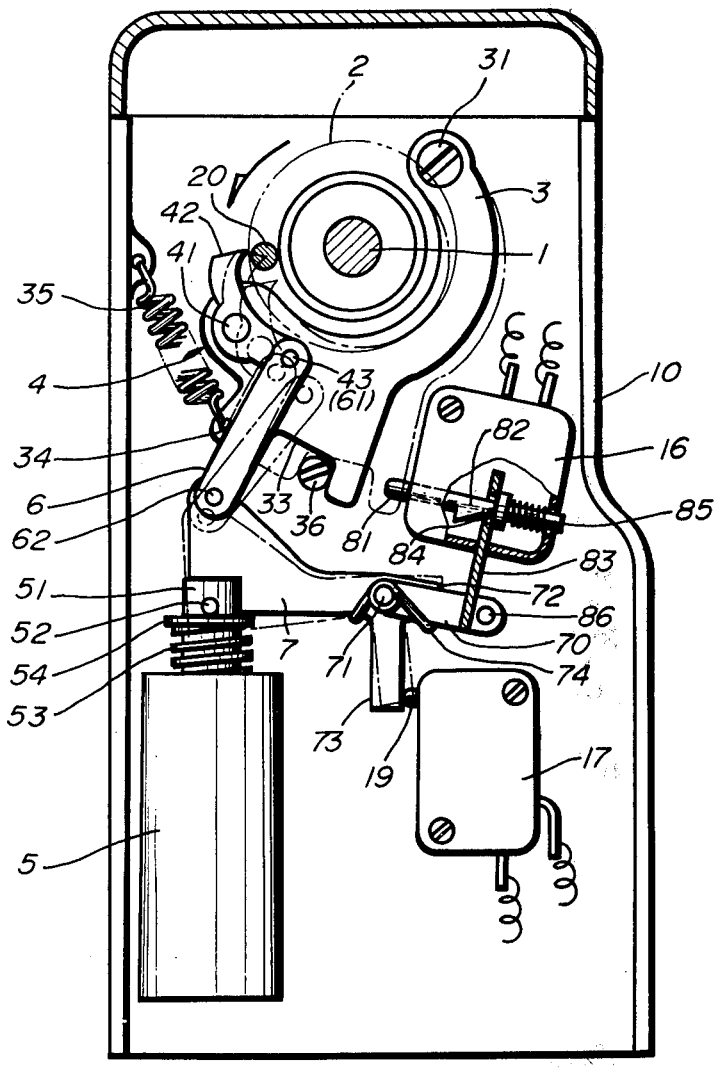
FIG. 7 is a sectional view of a third embodiment of the invention.

FIG. 7 shows a third embodiment of this invention. This embodiment is provided with a self maintaining switch 16 which is operated by the swingable lever 3 and a power supply maintaining switch 17 which is operated by the intermediate lever 7 to supply electric current to the motor M and the solenoid 5. According to this embodiment, intermittent rotation of the upper drive shaft 1 can be achieved by continuously holding down the controller, as well as by alternately pressing and releasing the controller as in the first and second embodiments of this invention.

Figure 8:
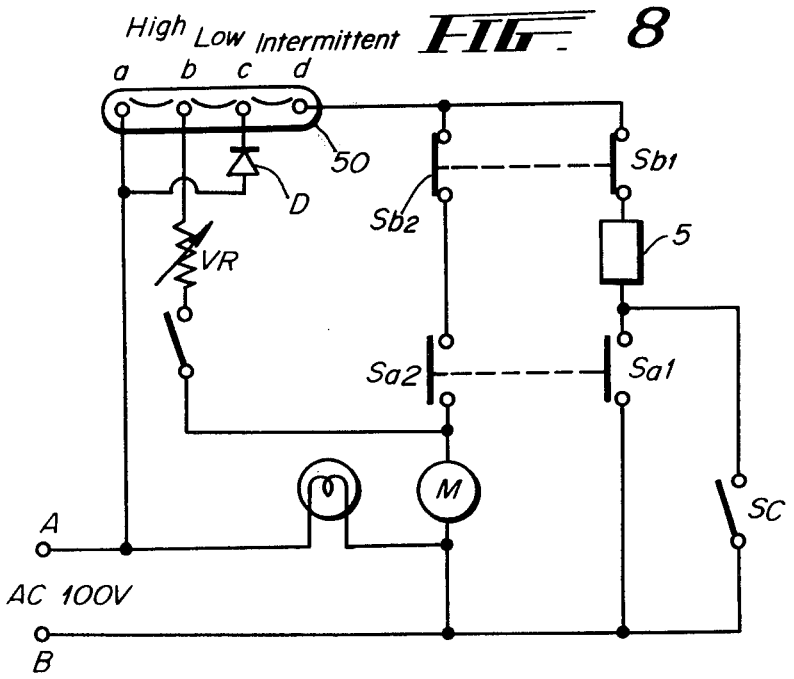
FIG. 8 illustrates an electric control circuit for use in the third embodiment of the invention.
Figure 9:
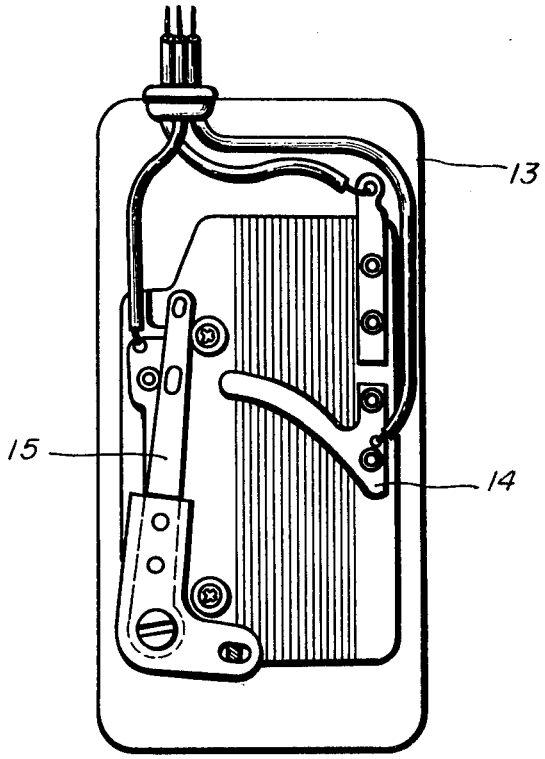
FIG. 9 is a plan view of the interior of the foot controller in the third embodiment.
Figure 10:
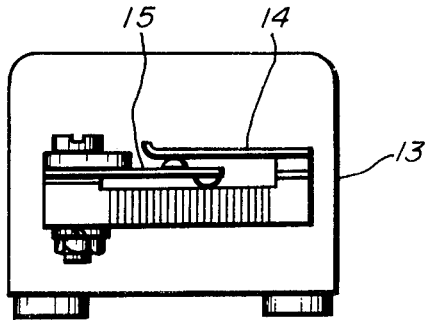
FIG. 10 is an end elevational view of the foot controller of FIG. 9.

FIG. 8 shows a control circuit for the third embodiment of the invention, in which the circuit for controlling the intermittent rotation of the upper drive shaft 1 consists of a motor circuit and a solenoid circuit arranged in parallel to each other between the contact (*d*) of the changeover switch 50 and the power supply terminal B. These parallel circuits include, respectively one contact $Sa_1$ and the other contact $Sa_2$ of the power supply maintaining switch 17, and one contact $Sb_1$ and the other contact $Sb_2$ of the self-maintaining switch 16. The contacts $Sa_1$ and $Sa_2$ are operated to close one by one by the solenoid 5 when it is energized, and the contacts $Sb_1$ and $Sb_2$ are operated to open by the turning action of the swingable lever 3. The control circuit further includes a contact Sc arranged in parallel to the contact $Sa_1$, and operated to close and open by respectively pressing and releasing the controller (FIGS. 9–10). The contact Sc is composed of a conductor plate 14 and a wiper 15 which are arranged in the foot controller 13. The conductor plate 14 is located above the resistor winding and is spaced from the same. The wiper 15 acts as a starting switch. It is insulated and connected to the conductor plate 14 by actuating changeover switch 50. Further in this embodiment as shown in FIG. 7, the intermediate lever 7 is provided with a depending arm 73 to act on the movable portion 19 of the power supply maintaining switch 17. A lever 70 is provided for acting on the self-maintaining switch 16. The lever 7 is at one end thereof turnably mounted on the pivot pin 71 of the intermediate lever 7. The lever 70 is biassed upwardly by means of a torsion spring 74. The upward turning movement of the lever 70 is prevented by an engaging piece 72 formed on the intermediate lever 7. The lever 70 is connected to the pin 81 by means of a detaining member 83 which is at one end connected to the free end of the lever 70 and is at the other end connected to the pin 81 by means of a hole 84 formed in the other end thereof, which surrounds the pin 81. The pin 81 is formed with a saw tooth 82 and is biassed by a coil spring 85 in a direction to the left, as viewed in FIG. 7.

Since the two contacts $Sb_1$ and $Sb_2$ of switch 16 are normally closed, when the contacts (*c*) and (*d*) of the changeover switch 50 are connected to each other and the controller 13 is pressed down, the contact S*c* is closed thereby energizing the solenoid 5. When the solenoid 5 is energized, it pulls down the intermediate lever 7 against the action of the coil spring 53 and moves the pawl 4 into the path of movement of the engaging pin 20 through the link 6. When the intermediate lever 7 is pulled down to the position shown by phantom lines, the depending arm 73 depresses the button 19 of the power supply maintaining switch 17 and, the contacts S*a*, and $Sa_2$ are closed to supply electric energy to the motor M and to the solenoid 5. The solenoid 5 remains energized by its holding circuit. As the upper drive shaft 1 rotates in the direction shown by the arrow and the pin 20 engages the pawl 4, the swingable lever 3 is rotated against the action of the tension spring 35 in a counter clockwise direction, and the swingable lever 3 depresses the pin 81 of switch 16 against the action of the coil spring 85 until the saw tooth 82 of the pin 81 enters the hole 84 of the detaining member 83 and is detained there. When the pin 81 of switch 16 is depressed by the swingable lever 3, the contacts $Sb_1$ and $Sb_2$ are opened to stop power supply to the motor M and to the solenoid 5. The upper drive shaft 1 of the sewing machine is stopped at a predetermined position, and then the swingable lever 3 is returned to the inoperative position under the action of the tension spring 35. Simultaneously the pawl 4 is moved out of the path of movement of the pin 20 by the restoring action of the coil spring 53 via the intermediate lever 7 and link 6. In the meanwhile, when the intermediate lever 7 is lifted by the action of the coil spring 53, the depending arm 73 of the lever 7 is disengaged from the button 19 of the power supply maintaining switch 17. Simultaneously the lever 70 is turned by the intermediate lever 7 in a clockwise direction, and the detaining member 83 is pulled down. As a result, the hole 84 of the detaining member releases the saw tooth 82 and allows the pin 81 to return to the extended position due to the action of the coil spring 85. Thus the contacts $Sb_1$ and $Sb_2$ of switch 16 are closed and the control circuit is restored to the initial condition to rotate the upper drive shaft 1.

As is apparent from this embodiment of the invention, the control circuit is completed at regular intervals after it is opened due to the operation of the self-maintaining switch 16. It is, therefore, apparent that if the foot controller 13 is kept pressed down, the upper drive shaft 1 of the sewing machine is intermittently and successively rotated in a predetermined cycle and successive intermittent stitches can be produced automatically. The length of intervals between successive intermittent rotations of the upper drive shaft 1 is determined by the delayed return movement of the pin 81 of the self-maintaining switch 16, which is moved to the extended position by the action of the coil spring 85 when it is released from the detaining member 83 after having been detained thereby. It would, therefore, be apparent that desired and ideal intermittent stitches can be automatically produced in this embodiment of invention by appropriately selecting parts as a detaining device which operate with a certain delay relative to the associated parts. Further, in this embodiment, intermittent stitches can be produced by repeatedly stepping and releasing the foot controller as in the first and second embodiments of this invention. In this case, however, the foot controller has to be released before the pin 20 of the engaging member 2 completes one orbit from the position where it was stopped. Moreover, since the solenoid 5 is kept energized by the operation of the power supply maintaining switch 17, an intermittent stitch can be produced each time when the controller 13 is depressed irrespective of the length of the interval during which the controller is held down as long as the pin 20 is on the way to engage the pawl 4.

I claim:

1. A sewing machine comprising, in combination, a housing; a drive shaft rotatably journalled in said housing; an electric motor for rotating said drive shaft and thereby to vertically reciprocate a needle bar; and an intermittent stitching device, said intermittent stitching device comprising engaging means mounted on said shaft for rotation therewith, arresting means normally positioned in an inoperative position permitting the operation of said motor, and moved to an operative position interrupting the operation of said motor when rotation of said engaging means is blocked, blocking means supported on said arresting means and movable between a first position remote from and a second position in the path of the rotation of said engaging means for blocking the rotation of said engaging means when in said second position where the blocking means transmits the movement of said engaging means to said arresting means to move said arresting means from said inoperative position to said operative position interrupting the operation of said motor, and actuating means for moving said blocking means from said first to said second position and from said second to said first position in response to an externally applied start signal, said actuating means comprising a solenoid having an armature, and a control circuit means including a power source, foot controller switch means connected to said power source and externally operable to furnish said start signal, and start switch means for connecting said motor and the solenoid to said power source upon receipt of said start signal.

2. A sewing machine as claimed in claim 1, further comprises stop switch means connected between said motor, said solenoid and said power source for disconnecting said motor and said solenoid from said power source when open; and wherein said arresting means comprises means for opening said stop-switch means when in said operative position.

3. A sewing machine as claimed in claim 1, wherein said engaging means comprises a bushing secured on said shaft and a pin fixedly attached to said bushing in a position radially spaced from the axis of rotation of said shaft.

4. A sewing machine as claimed in claim 3, wherein said blocking means comprises a pawl pivotally supported on said arresting means and having a palette for engaging said pin, thereby to block the rotation of said shaft.

5. A sewing machine as claimed in claim 4, wherein said arresting means comprises a lever swingably mounted on said housing and means acting on said lever to bias said lever to said inoperative position.

6. A sewing machine as claimed in claim 5, wherein said means acting on said lever to bias said lever to said inoperative position comprises a biasing spring.

7. A sewing machine as claimed in claim 6, wherein an impact is transmitted to said lever when said pin engages said palette of said pawl, and wherein said impact turns said lever against the action of said spring from said inoperative position to said operative position.

8. A sewing machine comprising, in combination, a housing; a drive shaft rotatably journalled in said housing; an electric motor for rotating said drive shaft thereby to vertically reciprocate a needle bar; and an intermittent stitching device, said intermittent stitching device comprising engaging means mounted on said shaft for rotation therewith, arresting means movable between an inoperative position and an operative position to respectively permit and interrupt the operation of said motor, blocking means supported on said arresting means and movable between a first position remote from and a second position in the path of movement of said engaging means for blocking the rotation of said engaging means when in said second position, and actuating means for moving said blocking means from said first to said second and from said second to said first position in response to an externally applied start signal, said actuating means comprise a solenoid having an armature, and control circuit means for controlling the actuation of said solenoid in response to said start signal including a power source, foot controller switch means connected to said power source and externally operable to furnish said start signal, and start switch means for connecting said motor and said solenoid to said power source upon receipt of said start signal; coupling means for coupling said blocking mans to said armature in such a manner that said blocking means moves from said first to said second position upon energization of said solenoid; stop-switch means connected between said motor, said solenoid and said power source for disconnecting said motor and said solenoid from said power source when open; said arresting means comprising means for opening said stop-switch means when in said operative position.

9. A sewing machine as claimed in claim 8, wherein said blocking means comprises a pawl pivotally supported on said arresting means and having a palette for engaging said engaging means, thereby blocking the rotation of said shaft; and wherein said coupling means comprises a connecting link connected to said pawl, and a coupling lever turnably mounted on said housing and connected to said connecting link and said armature of said solenoid.

10. A sewing machine as claimed in claim 9, wherein said actuating means further comprises spring means for moving said blocking means and said arresting means to said first and said inoperative position, respectively, following the deenergization of said solenoid.

11. A sewing machine as claimed in claim 10, wherein said start-switch means comprises relay means having a coil connected to said foot controller switch means in such a manner that said coil is energized upon operation of said foot controller switch means, and wherein said relay means further comprises normally open relay contacts for connecting said motor and said solenoid to said power source upon energization of said relay coil.

12. A sewing machine as claimed in claim 10, wherein said start-switch means comprises a pair of normally open switches; and wherein said coupling means further comprises means for closing said normally open switches in response to energization of said solenoid.

13. A sewing machine as claimed in claim 12, wherein said intermittent stitching device is operative when said foot controller switch means is continuously depressed; further comprising detaining means operative after said arresting means has left said operative position for maintaining said stop-switch means in said open position; further comprising means coupled to said armature of said solenoid for moving said detaining means to a position allowing closure of said stop-switch means following denergization of said solenoid and opening of said normally open switches.

* * * * *